US011114760B2

(12) United States Patent
Golkowski et al.

(10) Patent No.: US 11,114,760 B2
(45) Date of Patent: Sep. 7, 2021

(54) MAGNETIC SHUTTER ANTENNA

(71) Applicant: The Regents of the University of Colorado, a body corporate

(72) Inventors: Mark Golkowski, Denver, CO (US); Jae-Do Park, Highlands Ranch, CO (US); Ronald A. L. Rorrer, Highlands Ranch, CO (US); Zbigniew Celinski, Colorado Springs, CO (US)

(73) Assignee: The Regents of the University of Colorado, a body corporate, Denver, CO (US)

( * ) Notice: Subject to any disclaimer, the term of this patent is extended or adjusted under 35 U.S.C. 154(b) by 0 days.

(21) Appl. No.: 16/197,335

(22) Filed: Nov. 20, 2018

(65) Prior Publication Data

US 2019/0157761 A1 May 23, 2019

Related U.S. Application Data

(60) Provisional application No. 62/588,850, filed on Nov. 20, 2017.

(51) Int. Cl.

| | |
|---|---|
| ***H01Q 3/44*** | (2006.01) |
| ***H01Q 3/04*** | (2006.01) |
| ***H01Q 3/26*** | (2006.01) |
| ***H01Q 3/20*** | (2006.01) |
| ***H01Q 1/12*** | (2006.01) |

(52) U.S. Cl.
CPC ..... *H01Q 3/44* (2013.01); *H01Q 1/1264* (2013.01); *H01Q 3/04* (2013.01); *H01Q 3/20* (2013.01); *H01Q 3/2611* (2013.01)

(58) Field of Classification Search
CPC .. H01Q 3/44; H01Q 3/04; H01Q 3/20; H01Q 3/2611; H01Q 1/1264
See application file for complete search history.

(56) References Cited

U.S. PATENT DOCUMENTS

2014/0042834 A1* 2/2014 Asahi ..... H02K 1/04 310/43

* cited by examiner

*Primary Examiner* — Hoang V Nguyen
(74) *Attorney, Agent, or Firm* — FisherBroyles, LLP; Thomas J. Osborne, Jr.

(57) ABSTRACT

In one example embodiment, a magnetic shutter antenna is provided including at least one dipole magnet comprising a first end and a second end and at least one shutter of magnetically soft material comprising at least one opening and disposed proximate the first end of the at least one dipole magnet. The antenna further includes a motor coupled to the shutter and configured to move the shutter between a first closed position comprising the magnetic material being positioned adjacent the first end of the dipole magnet and a second open configuration comprising the opening being positioned adjacent the first end of the dipole magnet. Alternation between the first closed position and the second open position modulates a magnetic flux emitting from the first end of the at least one dipole magnet.

20 Claims, 14 Drawing Sheets

*16 Slot and Magnet Configuration*

*8 Slot and Magnet Configuration*

*8 Magnet Configuration*

MAGNETIC SHUTTER ANTENNA

CROSS-REFERENCE TO RELATED APPLICATIONS

This application claims the benefit of U.S. provisional application No. 62/588,850, filed Nov. 20, 2017, which is hereby incorporated by reference as though fully set forth herein.

BACKGROUND a. Field

The present disclosure relates to a magnetic shutter antenna. In particular, the present disclosure relates to a magnetic shutter antenna having a moveable shutter configured to modulate a field of a magnet.

b. Background

Electromagnetic radiation from 3 Hz to 30 kHz (ELF/ULF/VLF bands) has properties enabling unique applications. The relatively long skin depths enable use in environments where absorption precludes operation at higher frequencies. Skin depths of at least several meters in both seawater and the ground compensate the inherent low data rates of using these waves in subsurface applications. Geophysical prospecting and through conductor detection and imaging become possible in this band. Moreover, low loss reflection from the upper atmosphere facilitates global propagation exploited by maritime communications and non-satellite based global navigation systems. Waves of a few kHz also play an important role in wave-plasma interactions in the upper atmosphere and near-Earth space that are of intense interest to the scientific community.

Unfortunately, generating ELF-VLF waves is a significant engineering challenge. The free space wavelengths at these frequencies are on the order of tens to hundreds of kilometers, making it difficult, if not impossible, to construct an antenna of appreciable electrical length. Impedance mismatches and low radiation resistance ($<<1\Omega$) make short antenna systems inefficient and narrowband. Efficient ELF-VLF radiation with a portable system has long been a goal. Although exploiting the stored energy of a rotating static magnetic dipole has been proposed before, such systems have not been practical due to excessive spin rates.

BRIEF SUMMARY

Antennas for generating and transmitting Ultra Low Frequency (ULF) and Very Low Frequency (VLF) signals though the generation of electromagnetic (EM) fields are provided. In various example embodiments, mechanical approaches are provided in which the field of one or more stationary permanent dipole magnets is modulated by a movable shutter (e.g., a spinning or translating shutter) adapted to move in relation to the one or more stationary permanent dipole magnets. The movable shutter designs presented here reduce kinetic energy requirements allowing, in some embodiments, for radiation in the kHz range from a compact portable package.

In one embodiment, for example, a shutter device spins in relation to one or more stationary dipole magnets to alternatively block or allow the passage of magnetic signals through one or more openings of the shutter to generate an electromagnetic signal with a frequency equal to or greater than the shutter spin rate. Embodiments also provide a built-in motor which uses the magnetic field of one or more static dipole magnets to generate rotational action of the shutter in relation to the one or more stationary dipole magnets, thereby reducing or minimizing the need for additional magnets in these embodiments.

Various antenna embodiments provided herein are adapted to generate and transmit ULF and VLF systems with a portable system using a mechanically driven transmitter. Such a portable system need not be permanently affixed to one location and may be transported such as via a person, a vehicle or otherwise movable from one location to another.

Certain embodiments comprise a shutter including a magnetically soft material with equally spaced openings. When the shutter is moved (e.g., rotated or translated) in proximity to one or more permanent magnets, the shutter acts as a high-speed shutter system that generates oscillatory electromagnetic radiation through distortion of the magnetic field of the magnets.

Certain embodiments comprise a shutter including magnetic shielding material including at least one opening that allows magnetic flux from stationary permanent magnets to be alternatively blocked or passed through the unimpeded. The periodic distortion of the static magnetic field of the permanent magnets creates a time rate of change of field intensity leading to electromagnetic wave generation.

Certain embodiments comprise a first shutter and a second shutter disposed on opposite sides of a series of radially positioned stationary dipole magnets. The stationary magnets generate a field originating from the dipoles. The shutters, rotated in symmetry, provide openings for each dipole simultaneously. Each time the openings align with the poles of the dipole magnet, levels of magnetic flux on the exterior side of the shutter changes in relation to the magnetic flux levels on the exterior side of the shutter when the openings obscure the dipole magnets. Thus, alternatively blocking and allowing passage of magnetic signals through the openings to generate a time varying signal wave-form.

Certain embodiments comprise a shutter having an equal number of openings and dipole magnets, and the openings are configured to be aligned with the dipole magnets. As such, any configuration of a first opening with a first dipole magnet results in an identical configuration for a second opening and with a second dipole magnet, etc. Thus, when a shutter aligns to an "open" or "shield window" configuration where the apertures are aligned with the dipole magnets, each of the magnetic dipoles are exposed to allow the magnetic flux to pass through unimpeded. Similarly, when the shutter aligns to a "closed" or "shield sandwich" configuration, all the magnet dipoles are obscured to maximize the blockage of magnetic flux from passing through the shutter.

It will be appreciated that the frequency of magnetic field distortion of certain embodiments is equal to the shutter spin rate multiplied by the number of openings in the at least one shutter. As such a 1 kHz frequency can be achieved with a shutter having eight openings by spinning the shutter at a rate of 7500 RPM. Similarly, a 1 kHz frequency can be achieved with a shutter having sixteen openings by spinning the shutter at a rate of 3750 RPM.

Certain embodiments comprise a motor integrated into the antenna. The motor utilizes the magnetic field of the static dipole magnets. Integrating a motor within the antenna which utilizes the magnetic field of the static dipole magnets effectively reduces the weight, envelope and power required to operate the antenna.

It will also be appreciated by one of ordinary skill in the art that the present embodiments are not limited to the use of dipole magnets, and may utilize 4-pole magnets, 8-pole magnets or other magnetic configurations while remaining within the scope and spirit of the present disclosure.

The foregoing and other aspects, features, details, utilities, and advantages of the present invention will be apparent from reading the following description and claims, and from reviewing the accompanying drawings. The above-described embodiments, objectives and configurations are neither complete nor exhaustive. As will be appreciated, other embodiments are possible using, alone or in combination, one or more features set forth above or described below. Further, this Summary is neither intended nor should it be construed as being representative of the full extent and scope of the present disclosure.

DETAILED DESCRIPTION

Figure 1B:
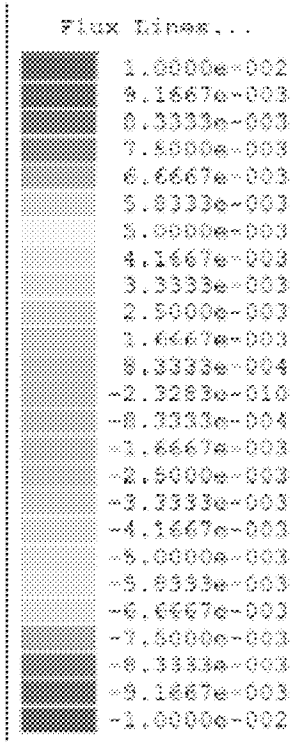
FIG. 1B shows distortion of magnetic field lines shown in an open configuration of certain embodiments.
Figure 1B:
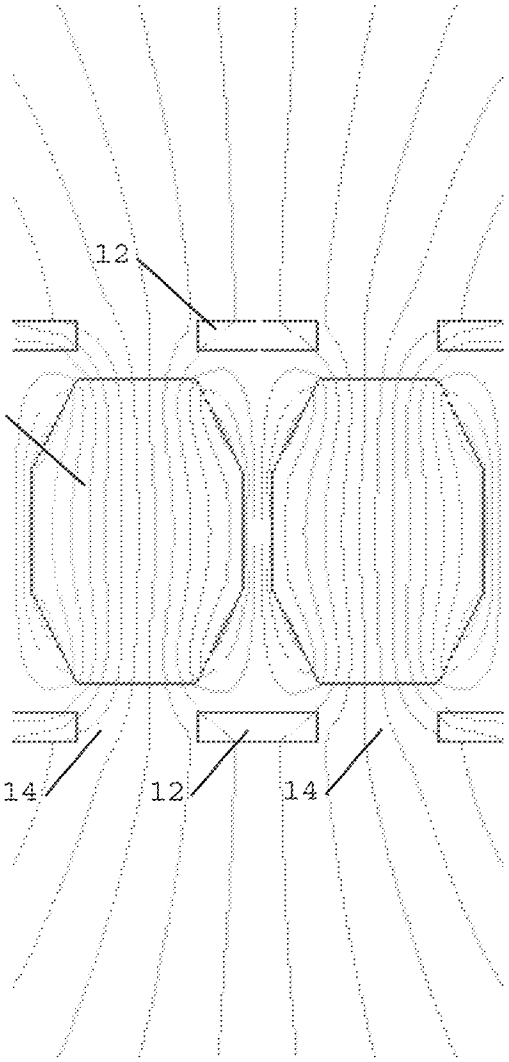
Figure 1A:
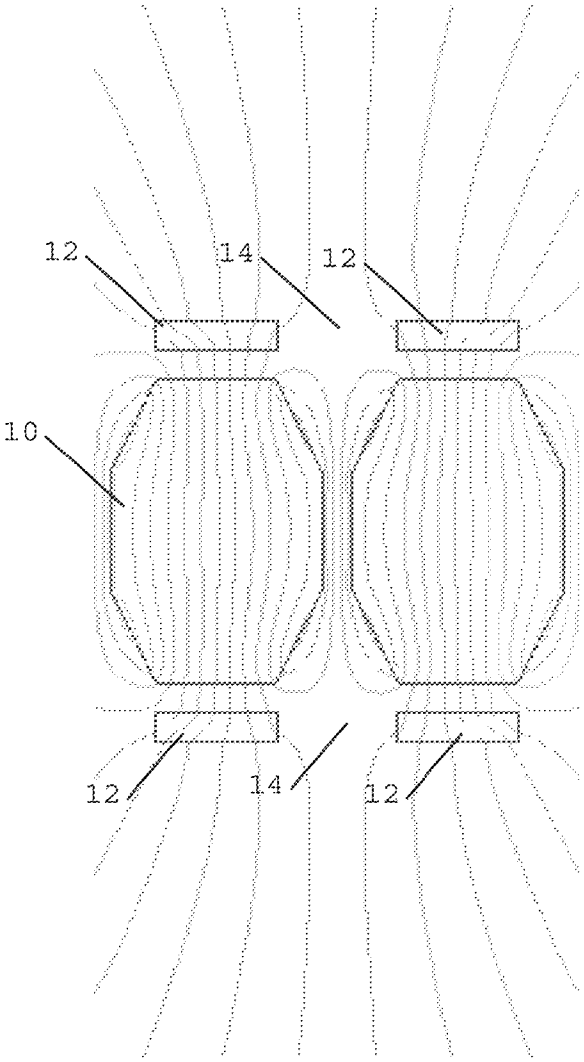
FIG. 1A shows distortion of magnetic field lines shown in an open configuration of certain embodiments.

FIGS. 1A and 1B show example embodiment of dipole magnets 10 and shutters 12 including openings 14 disposed within the shutter 12. The shutter 12 is formed of a magnetic material that is adapted to block or alter the magnetic flux emitting from the dipole magnets. As shown in FIGS. 1A and 1B, the alternating openings 14 and shutter 12 material provide "open" (FIG. 1B) and "closed" (FIG. 1A) configurations in which the magnetic flux emitting from the dipole magnets are modulated by the shutter moving across the ends of the dipole magnets 10.

Figure 2A:
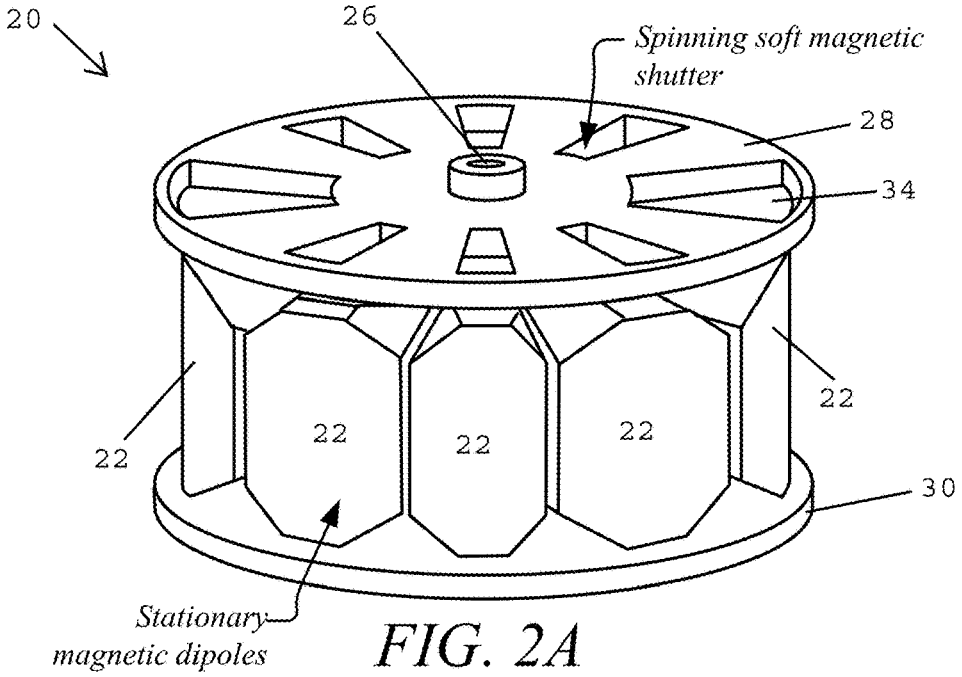
FIGS. 2A-2C show various views of example embodiments of dipole magnets and shutter configurations.
Figure 2B:
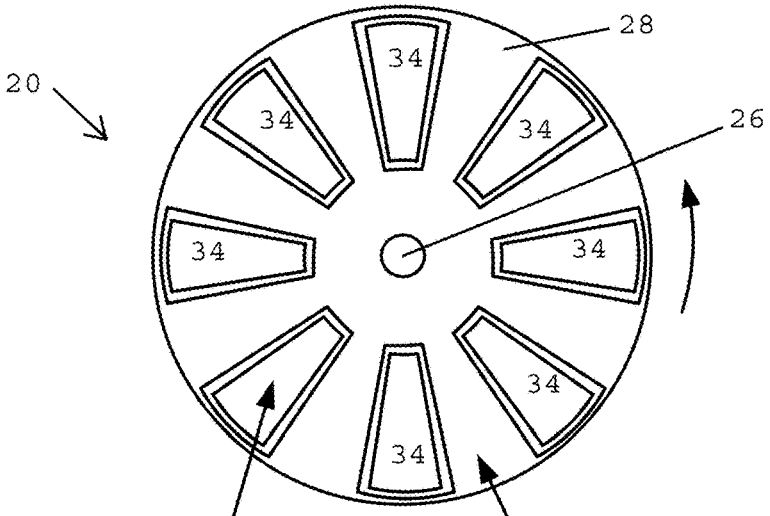
Figure 2C:
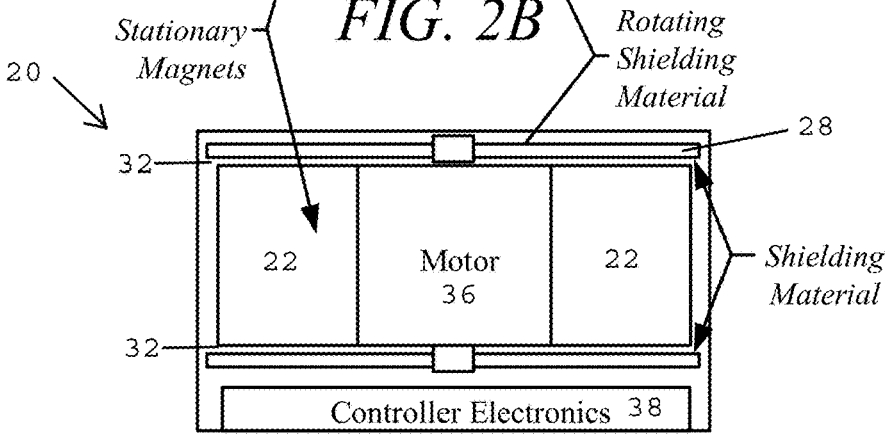

FIG. 2A shows a perspective view of one example embodiment of a magnetic shutter antenna 20. FIG. 2B shows a top or bottom plan view of the antenna 20 and FIG. 2C shows a side cross-sectional view of the antenna 20. In this embodiment, the antenna 20 comprises a plurality of fixed dipole magnets 22 arranged in a radial array 24 around a central axis 26. A first shutter 28 is disposed proximal to a first side of the radial array 24 with the first shutter 28 centered with the center of the array 24 of the dipole magnets 22. A second shutter 30 is disposed proximal to a second side of the radial array 24 opposite the first side with the second shutter 30 centered with the center of the radial array 24. The first and second shutters 28, 30, in some embodiments, are arranged offset outward from the first and second sides of the radial array 24 providing a gap 32 between each of the shutters 28, 30 and the ends of the dipole magnets 22 forming the array 22. In one embodiment, for example the first and second shutters 28, 30 are each offset from the first and second sides of the radial array 24, respectively, by a distance of less than about 1.0 cm to provide a clearance gap between each of the sides of the radial array and the moveable (e.g., rotating) shutters so that the shutters 28, 30 are able to move without contacting the dipole magnets 22 of the array 24.

In the particular embodiment shown in FIGS. 2A-2C, for example, the first and second shutters each comprise a symmetrical configuration. The shutters in this example comprise a round form having symmetrical openings 34, evenly spaced around the central axis of the radial array of dipole magnets.

Certain embodiments comprises an array 24 of (N) number of dipole magnets 22 and at least one shutter comprising (N) number of corresponding windows/openings. In some embodiments, the magnets 22 comprise a radially tapering form extending from a first radius to a second radius. In the particular embodiment shown in FIGS. 2A-2C, for example, the first and second shutters 28, 30 each comprises eight openings evenly spaced and disposed within the magnetic material of the shutter, and the radial array 24 comprises eight corresponding dipole magnets 22 arranged to form the radial array 24. Any number of magnets and windows/openings may be provided, however, and may match or comprise different numbers of magnet dipoles and windows/openings.

In the particular embodiment shown in FIGS. 2A-2C, the first and second shutters 28, 30 are coupled to at least one motor 36, such as via a drive shaft of the at least one motor 36 such that the motor(s) may move (e.g., rotate) the first and second shutters 28, 30 with respect to the fixed radial array 24 of dipole magnets 22. A controller and electronics module 38 may be provided to provide control signals to the motor(s) 36 to control the operation of first and second the shutters 28, 30.

Figure 3A:
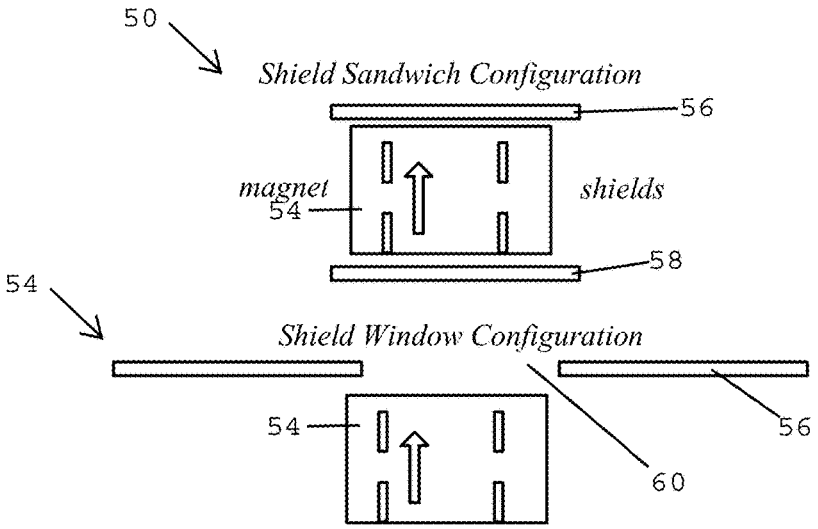
FIG. 3A shows an example diagrammatic view of a closed "sandwich" configuration and an open "window" configuration of certain example embodiments.

FIG. 3A shows an example diagrammatic view of a closed "sandwich" configuration 50 and an open "window" configuration 52 for a dipole magnet 54 and one or more shutters of a magnetic shutter antenna as described in more detail herein. In this particular example, the closed shield "sandwich" configuration 50 comprises a dipole magnet 54 of the antenna disposed between two shield elements 56, 58 of the magnetic material forming first and second shutters such that the shutters act as a shielding device for the dipole magnet(s) 54 disposed there between. The shutters provide shielding to affect the magnetic field emitted by the dipole magnet. In the open "window" configuration, an opening 60 is disposed opposite an end of the dipole magnet 54 allowing the magnetic field to emit through the opening 60. In some embodiments, for example, the difference in magnetic field emission from a closed configuration 50 (sometimes referred to as a "sandwich configuration"), and an open configuration 52 (sometimes referred to as a "window configuration") may vary as much as 50%. However, it will be appreciated that a 50% difference between an open and closed configuration may not be necessary for the effective use as an antenna. It will be further appreciated by those skilled in the art that the effectivity of an antenna may be determined based on the ability of a receiver to detect the signal generated by alternating open and closed configuration of the shutters.

Figure 3B:
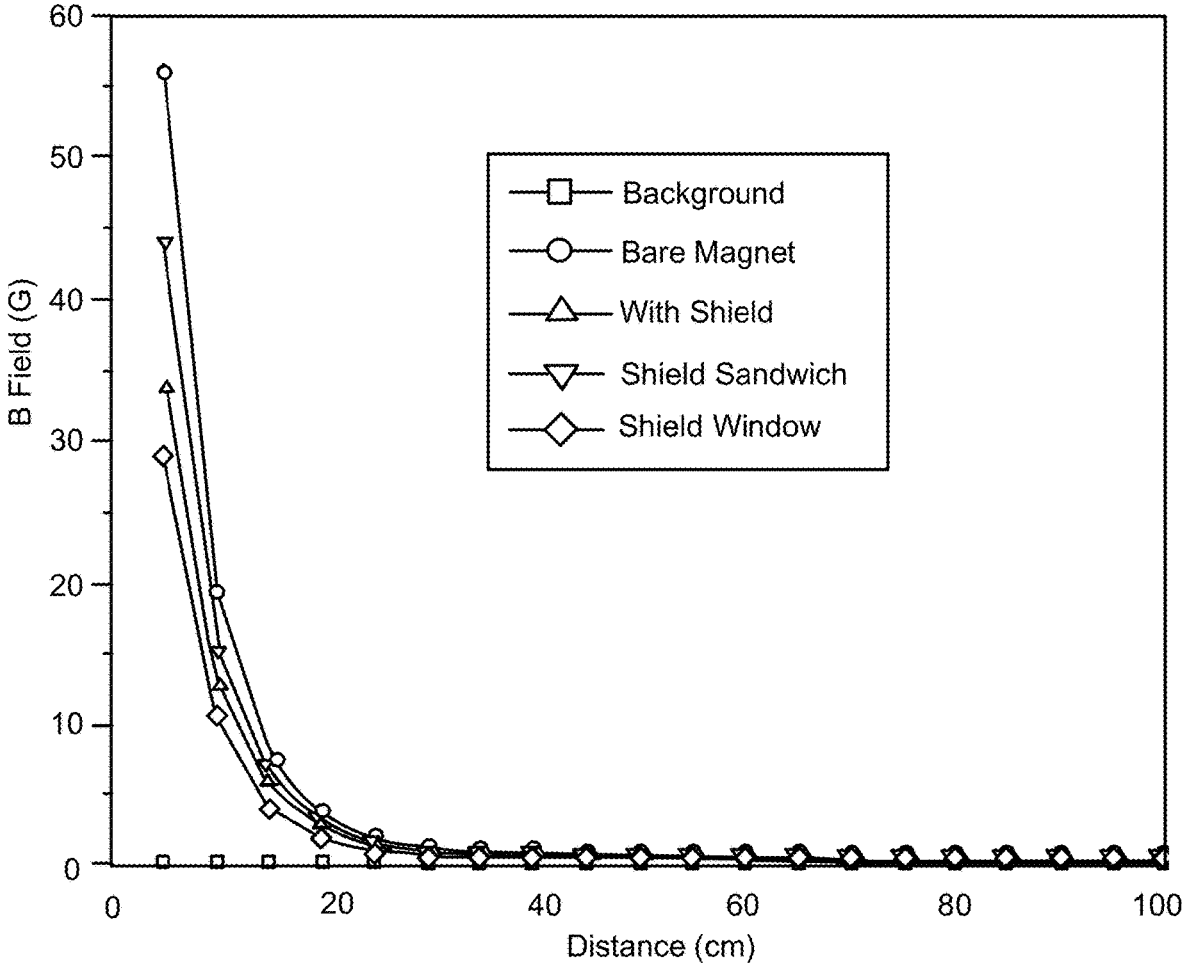
FIG. 3B shows magnetic field strength of certain example embodiments as a function of the distance of different shutters from the dipole magnets.

FIG. 3B is a graph showing example magnetic field strength as a function of the distance of different shutters from the dipole magnets for various embodiments of a magnetic shutter antenna.

Figures 4A, 4B, 4C:
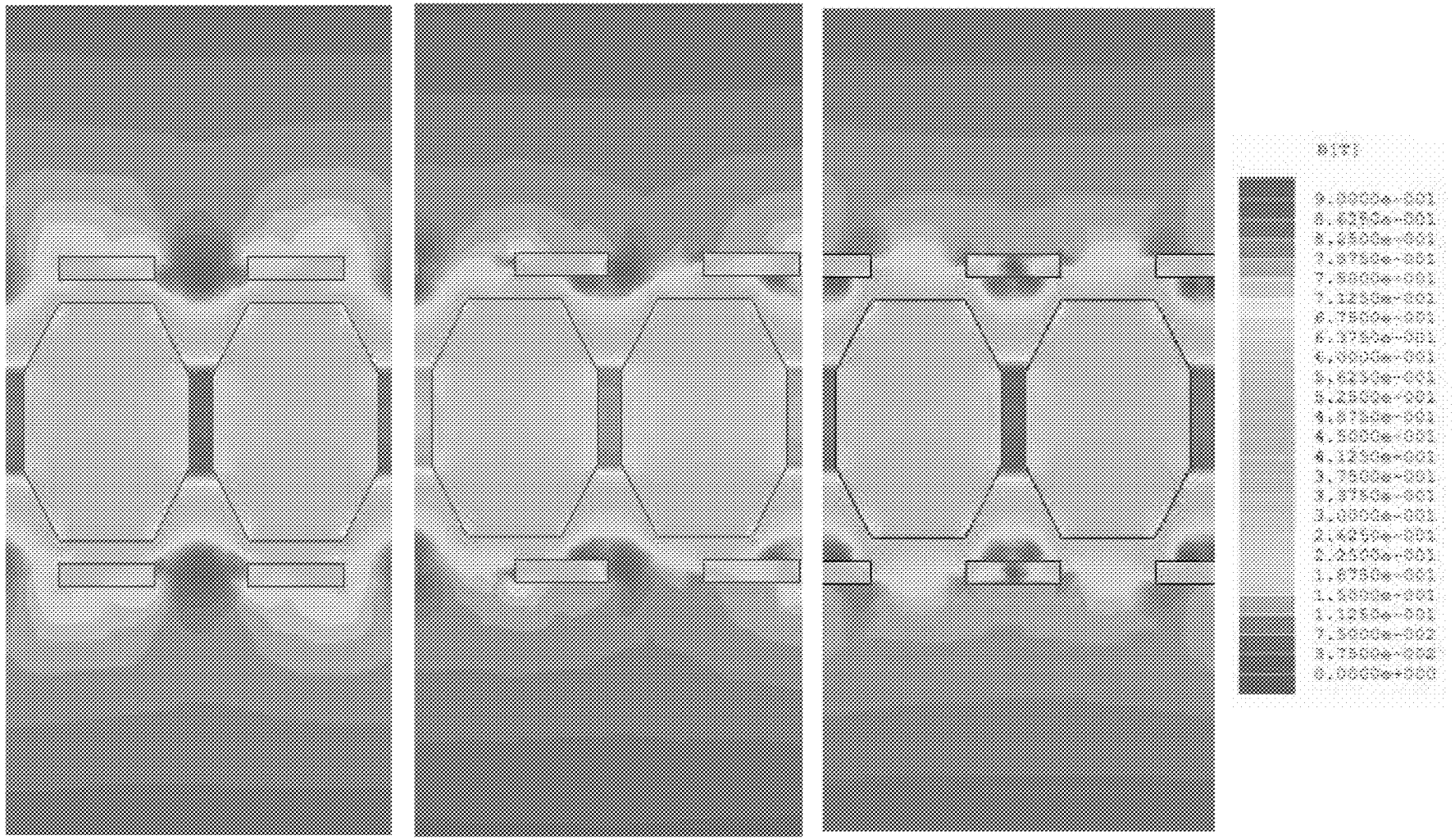
FIGS. 4A-4C show simulated magnetic fields of various embodiments.

FIGS. 4A-4C show simulated magnetic fields of various embodiments of a magnetic shutter antenna in which the rectangles disposed adjacent the inner magnets correspond to the shutter material and the open spaces correspond to the openings of the shutter.

Figure 5:
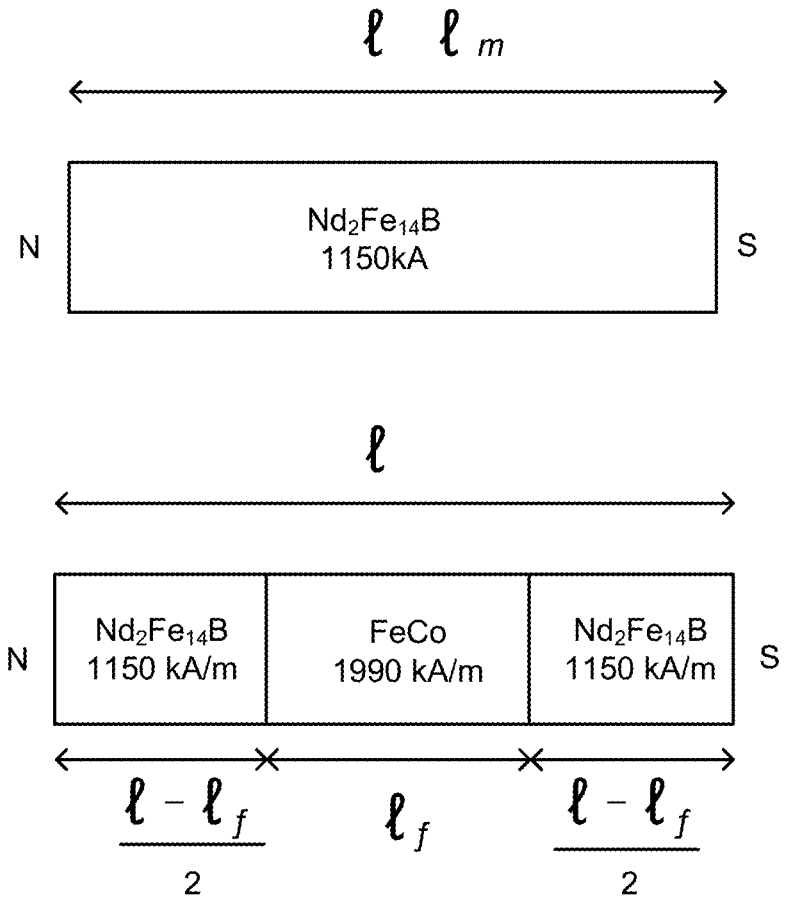
FIG. 5 shows example embodiments of dipole magnet configurations.

FIG. 5 shows examples of dipole magnets that may be used within a magnetic shutter antenna, such as shown and described herein. However, other types of magnets are known and could also be used within a magnetic shutter antenna as shown and described herein. In a first embodiment, shown on top for example, a magnetic dipole is made of a single highly anisotropic magnetic material such as, for example, a Neodymium Magnet ($Nd_2Fe_{14}B$), which is made from a permanent magnet material. In a second embodiment, a composite dipole magnet comprises a permanent magnet material combined with high magnetic saturation. A composite dipole magnet in certain embodiments comprises a permanent magnet material such as $Nd_2Fe_{14}B$ and a high moment magnetic material such as FeCo. It will be appreciated that a variety of different magnetic materials may be used in a magnetic shutter antenna. A composite dipole magnet results in a dipole magnet that exhibits a higher magnetic field in comparison with a monolithic dipole magnet made from a highly anisotropic magnetic material. A further benefit of certain embodiments of a composite dipole magnet is a decreased mass of a dipole magnet in comparison with an equally sized monolithic dipole magnet. It will be appreciated that lower mass and increased magnetic field are each generally desirable characteristics for certain embodiments of a magnetic shutter antenna.

Certain embodiments further comprise a magnet having a relatively high operating temperature threshold. An NdFeB magnet, for example grades N5014 or N4816, can operate continuously in temperatures up to 100 degrees C. However, an AlNiCo magnet, such as grade AC570, can operate up to temperatures of 525 degrees C. while maintaining a magnetic field only slightly weaker than that of a NdFeB magnet. In certain embodiments, Samarium ("Sm") based permanent magnets, such as but not limited to, $SmCo_5$ or $Sm_2CO_N$ can be used.

In certain embodiments, a shutter is rotated or translated in relation to a series of dipole magnets using a conventional motor, such as a brushed or brushless DC motor. Certain embodiments comprise an AC motor.

Figure 6A:
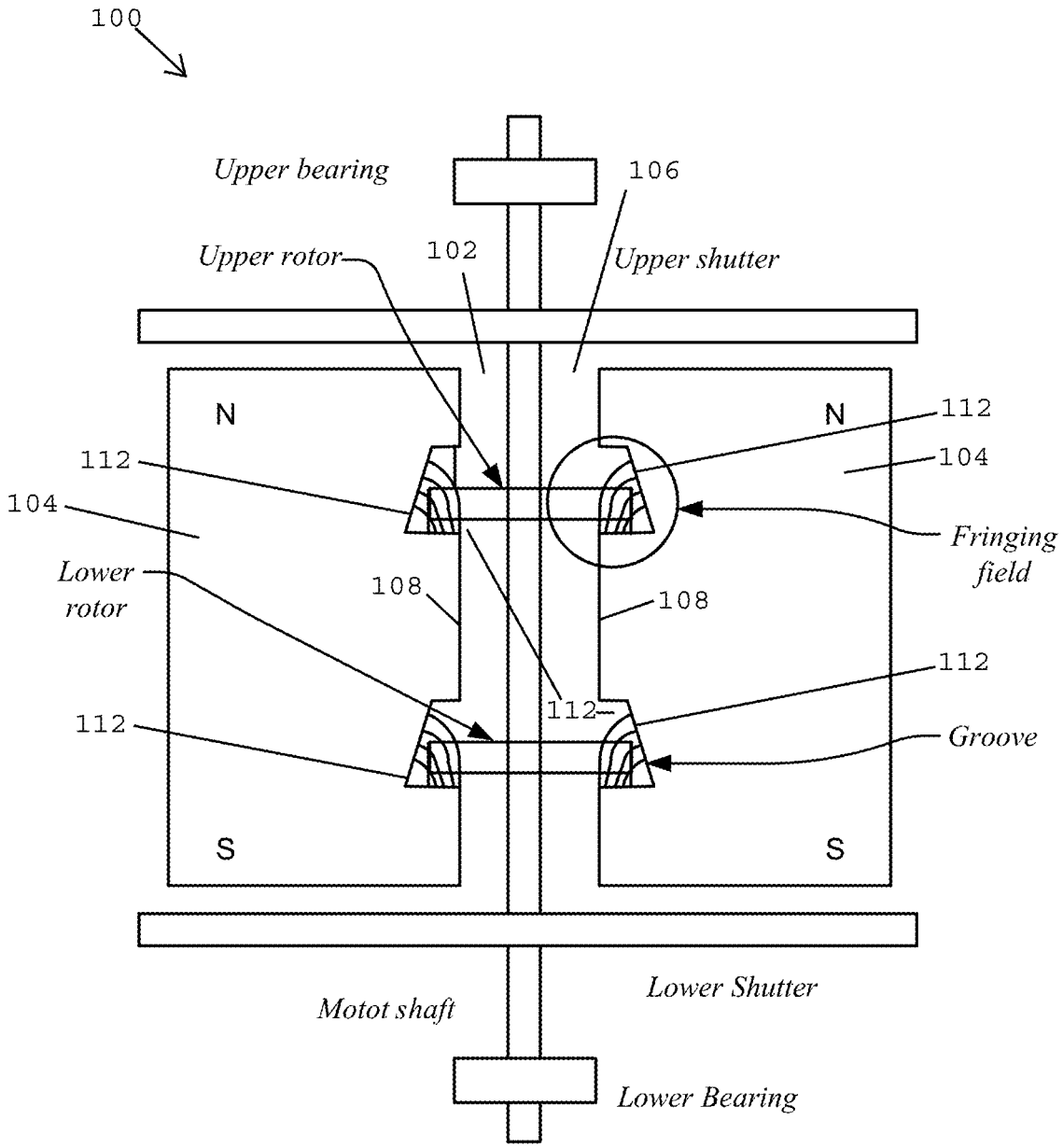
FIG. 6A shows a cross-sectional view of example embodiments of a magnetic shutter antenna having a built-in motor.
Figure 6B:
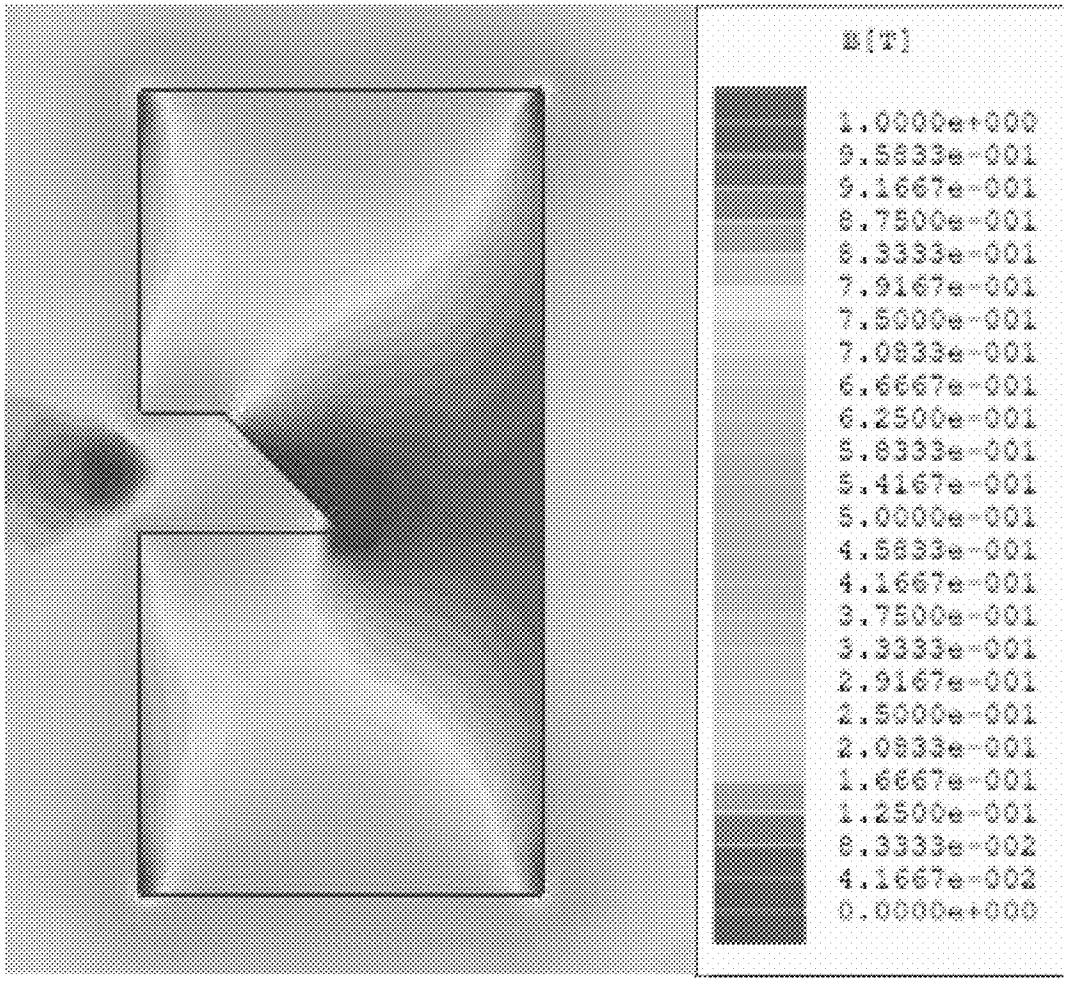
FIG. 6B shows a cross-sectional simulated view of magnetic flux density of certain example embodiments.

FIGS. 6A and 6B show example embodiments of a magnetic shutter antenna 100 comprising an internal motor 102 that utilizes the magnetic field of static dipole magnets of an antenna. In certain embodiments, for example, an array of static dipole magnets is arranged in a substantially radial array, such as a cylindrical shape. The radial array further comprises a central recess 106 in this embodiment. The central recess 106, having a substantially cylindrical form, the outer wall of which is bounded by an internal surface 108 of the static dipole magnets. The internal motor 102 is disposed within this recess 106.

In certain embodiments, as shown in FIGS. 6A-6B, the rotors of a motor are configured to index grooves 110 cut, scored or otherwise formed in an internal surface 108 of the static dipole magnets 104. The grooves 110 of the static dipole align to comprise a radial recess 112 in an outer wall of the central recess 106. Thus, the rotor of the motor, indexed within the groove 110, is exposed to a stronger magnetic field than would be otherwise experienced within the central recess. It will be appreciated that certain embodiments may comprise more than one rotor in a magnetic shutter antenna.

Figure 7A:
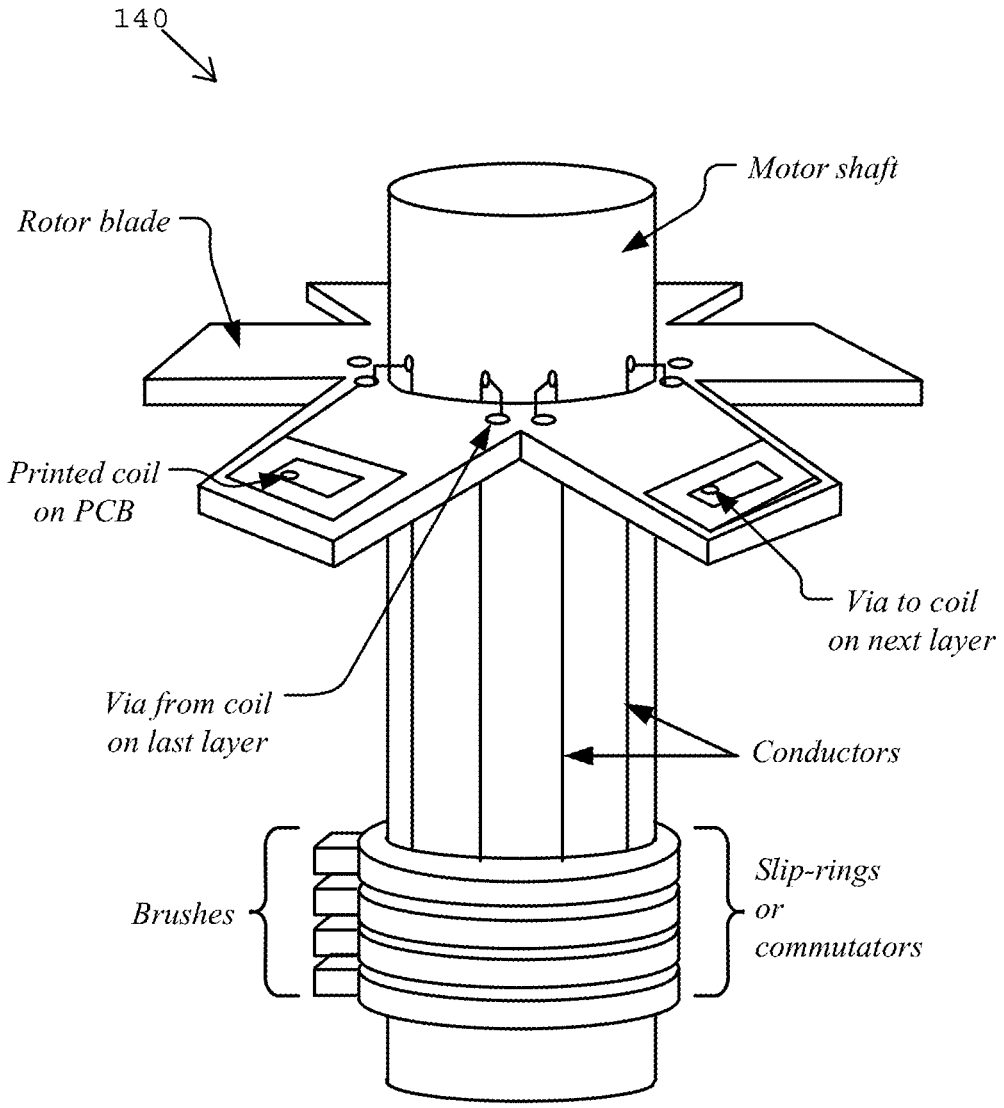
FIG. 7A show a perspective view of certain example embodiments of a built-in motor of a magnetic shutter antenna.
Figure 7B:
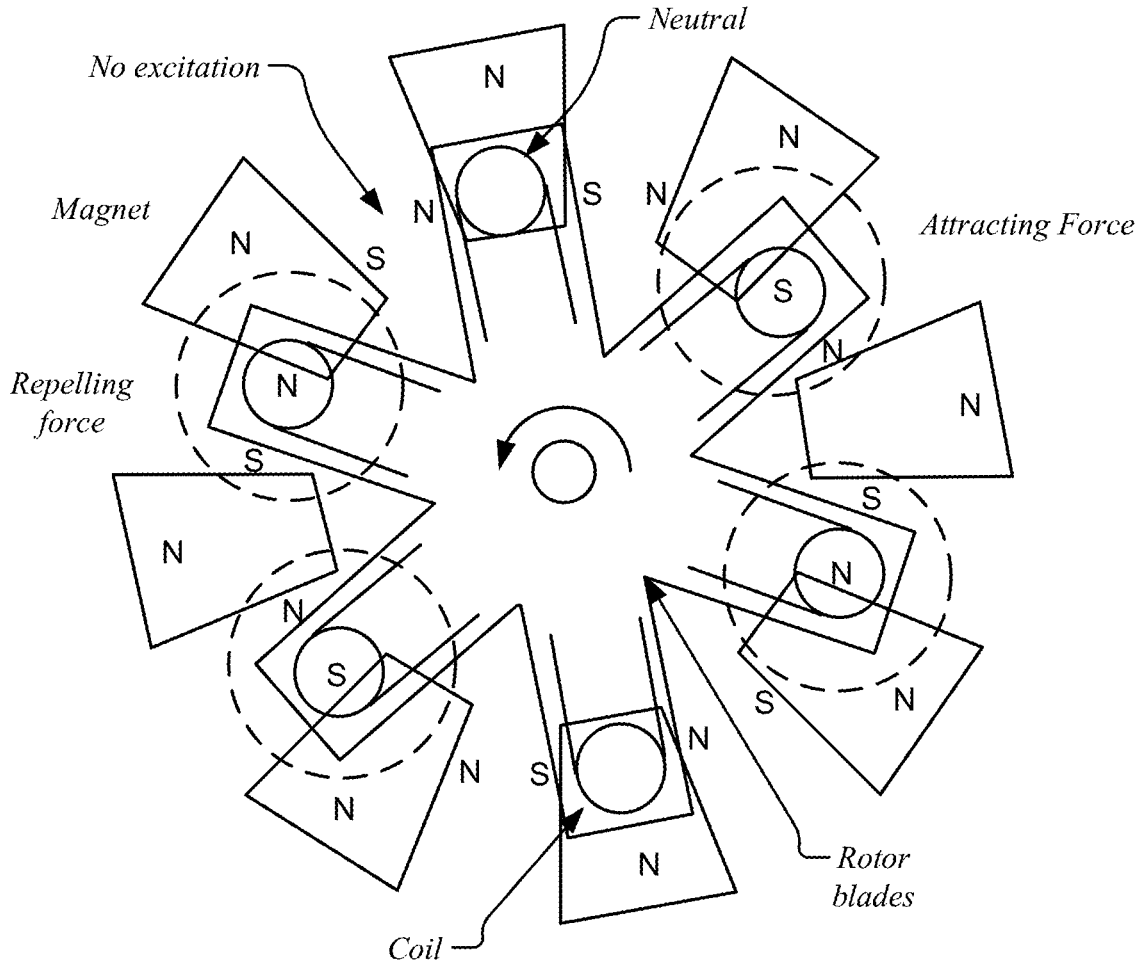
FIG. 7B shows a top view of certain example embodiments of a built-in motor of a magnetic shutter antenna.

FIGS. 7A and 7B shows a perspective view and a top view, respectively, of an example embodiment of a built-in motor for use in a magnetic shutter antenna. In this particular embodiment, for example, the motor comprises a rotor having a plurality of blades extending from a motor shaft. The blades in this embodiment comprise an inductive coil to carry electric current fed through the conductors affixed to the motor shaft. Applying electrical current to the coil results in an attracting or repelling force in relation to adjacent dipole magnets and the associated magnetic field. In embodiment comprising a groove which the blades of the rortor are indexed within the groove, the coil can be electrically excited at appropriate positions to generate an attracting force or repelling force as appropriate. It will be appreciated that in certain embodiments, it may be desired not to excite the coil of a rotor when the rotor is aligned with a dipole magnet to prevent generating a force counter to the direction of rotation of the motor.

Embodiments, such as shown in FIG. 7B, may comprise (N) number of dipole magnets and a rotor may comprise a plurality of blades. Certain embodiments comprise a number of blades not equal to (N). Furthermore, certain embodiments comprise a number of blades equal to (N−2). It will be appreciated that an inequality between the number of blades and the number of dipole magnets results in at least one blade in misalignment with a dipole magnet. It will be appreciated that having a blade in misalignment with a dipole magnet allows the supply of current through the coil of a blade to impart an attracting force or repelling force to generate a moment to spin the motor.

Figure 8A:
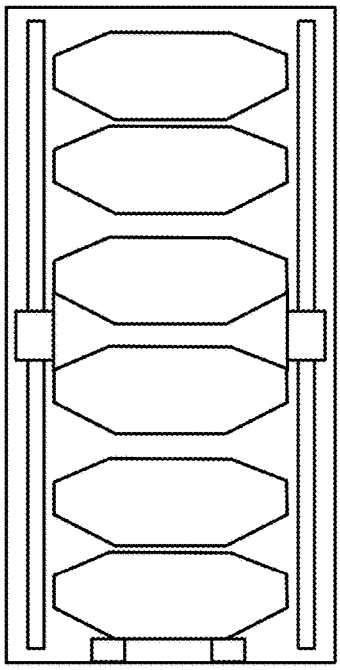
FIGS. 8A-8C show various views of example embodiments of a magnetic shutter antenna.

In an embodiment shown in FIG. 8A, for example, sixteen magnets are disposed in a radial array around a central recess. In certain embodiments, dipole magnets may comprise a tapererd profile resulting in a polygonal cross-sectional profile, such as an octagon. It will be appreciated that dipole magnets disposed in a radial configuration may be in direct contact or offset from adjacent dipole magnets.

Figure 8B:
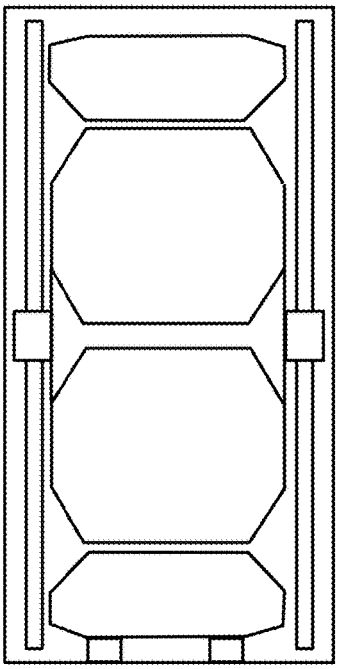
Figure 8C:
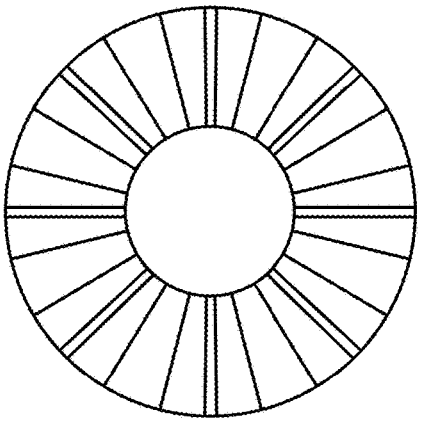

In certain embodiments, such as shown in FIGS. 8B and 8C, eight dipole magnets may be configured in a radial array configuration. In certain embodiments, for example, the dipole magnets comprise a tapered profile resulting in a polygonal cross-sectional profile, such as an octagon. It will be appreciated that dipole magnets in a radial configuration may be in direct contact with one another or offset from adjacent dipole magnets.

Figure 9:
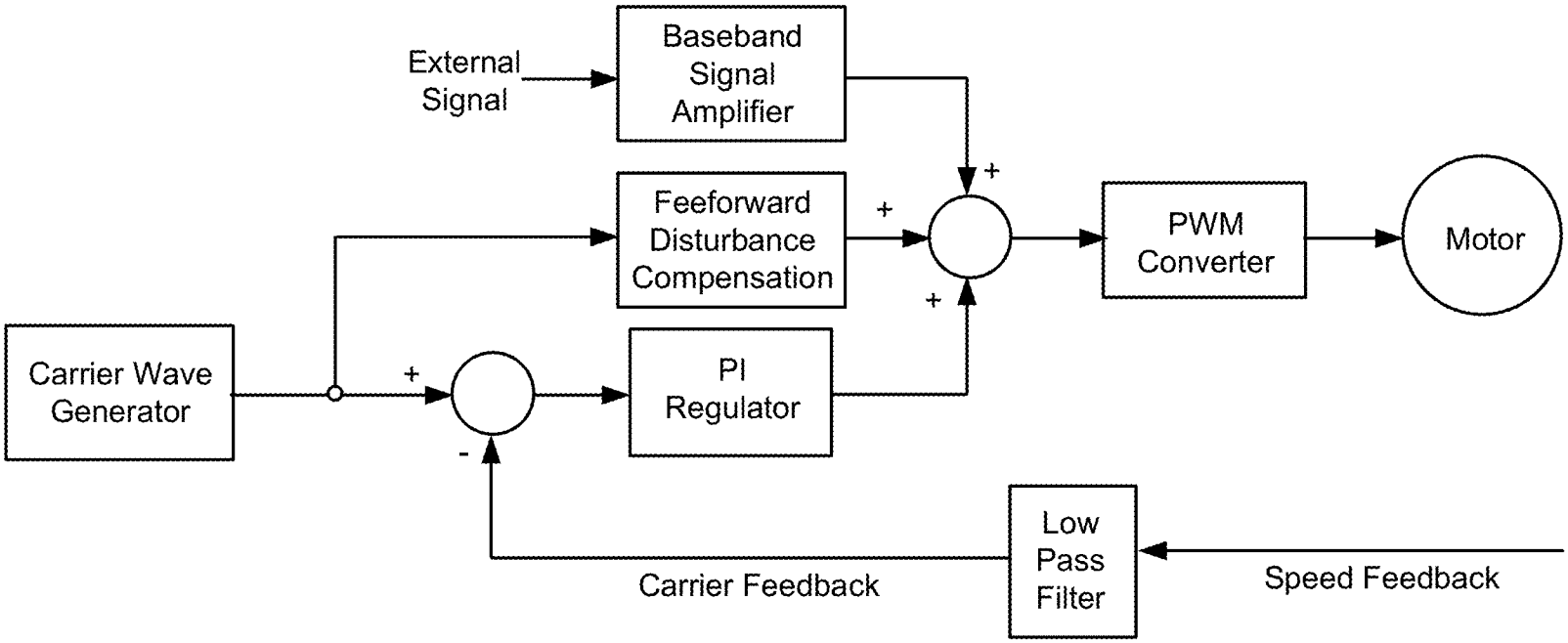
FIG. 9 shows an example motor drive system control diagram for various embodiments of a magnetic shutter antenna.

Certain embodiments comprise a drive system having a generator circuit, such as a frequency modulated generator circuit with a carrier speed regulator and a Pulse Width Modulation (PWM) based power conversion circuit for baseband and carrier waves as shown in FIG. 9. It will be appreciated that this is merely one example of a drive system and that other drive systems as appreciated by those skilled in the art may be used.

Figure 10:
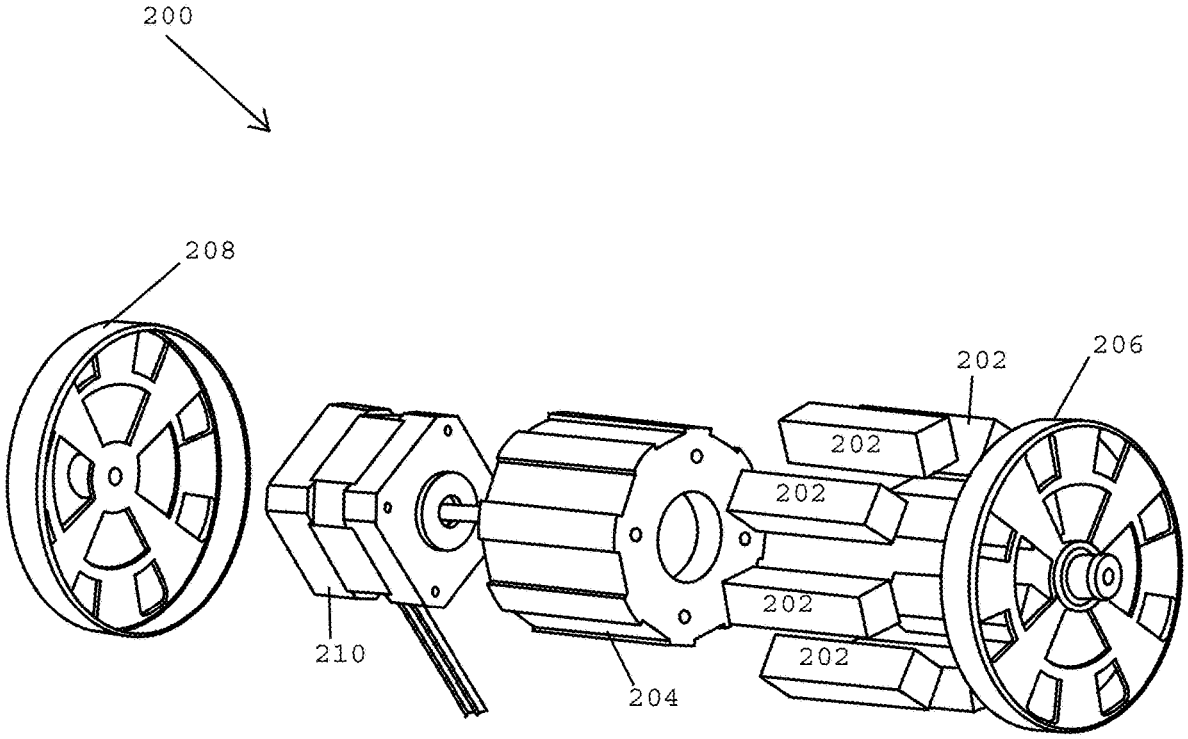
FIG. 10 shows a perspective view of an example embodiment of a mechanically based antenna.

Certain embodiments comprise a mechanical antenna 200 as shown in FIG. 10. In this particular embodiment, for example, the antenna 200 comprises eight dipole magnets 202 configured to be retained in a radial array by an armature 204. The mechanical antenna 200 further comprises a first shutter 206 and a second shutter 208 which are rotated by a motor 210.

It may be desired in certain embodiments to provide a shutter comprising openings that are filled with non-ferromagnetic material so as to reduce excessive airflow resistance at high speeds. Such practice is appreciated by those skilled in the art and disclosed in U.S. Pat. No. 1,008,577 to Alexanderson, incorporated by reference herein in its entirety.

Time dependent change of an electric or magnetic field yields electromagnetic radiation at the frequency of the variation. Thus mechanical rotation of a static magnetic dipole will generate a signal with frequency equal to the spin rate and amplitude proportional to the magnetic moment (mass) of the rotating dipole. Rotation of a finite mass above 60,000 rpm for >1 kHz of radiation frequency is challenging mechanically because of the significant bearing loss. Instead of rotating the magnetic mass, embodiments described herein provide for a movable shutter (e.g., rotating or translating shutter) used to modulate a static magnetic field, such as but not limited to, by spinning a shutter made of magnetically soft material with one or more openings in front of one or more static non-spinning magnetic dipoles. The number of openings, N, reduces the spin rate necessary to achieve a desired radiation frequency, w, to w/N. The static magnetic dipole field is alternately passed or distorted by the shutter. The proposed system resembles an optical semitransparent shutter in front of a light source. This concept has some similarity with the Alexanderson alternator, but the latter was not used to radiate directly and still coupled the mechanically synthesized waveform to a conventional antenna.

Figure 11:
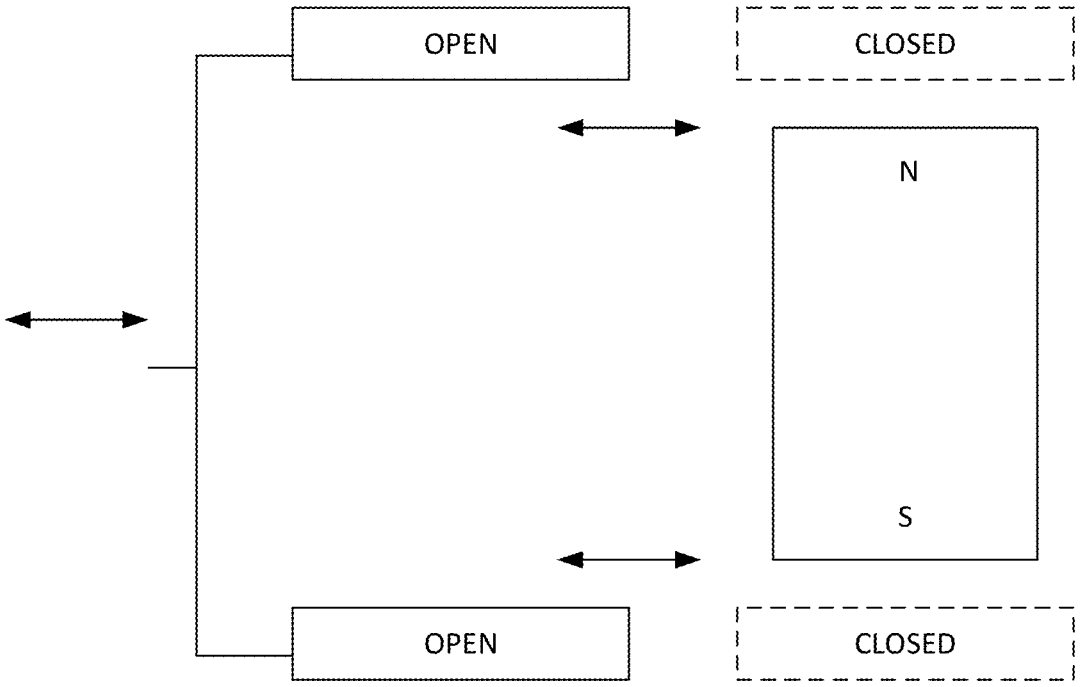
FIG. 11 shows an example embodiment of a magnetic shutter antenna in which translatable shutters are provided.

FIG. 11 shows yet another example embodiment of a magnetic shutter antenna in which translatable shutters are provided. In this particular embodiment, for example, the antenna comprises at least one dipole magnet and a translatable shutter assembly. A motor, for example, may be configured to translate the shutter assembly across the distal ends of the dipole magnet such that magnetic material of the shutter are disposed adjacent the distal ends of the dipole magnet in a first closed configuration and openings of the shutter (or a lack of a shutter) are disposed adjacent the distal ends of the dipole magnet in a second open configuration.

Figure 12A:
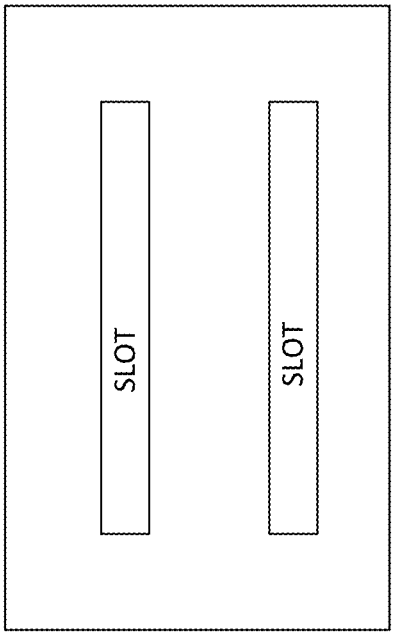
FIGS. 12A-12C show an example embodiment in which a pair of slotted enclosures is disposed concentrically around one or more dipole magnets.
Figure 12B:
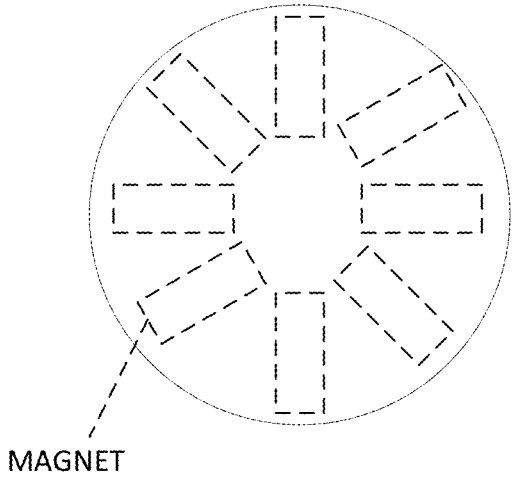
Figure 12C:
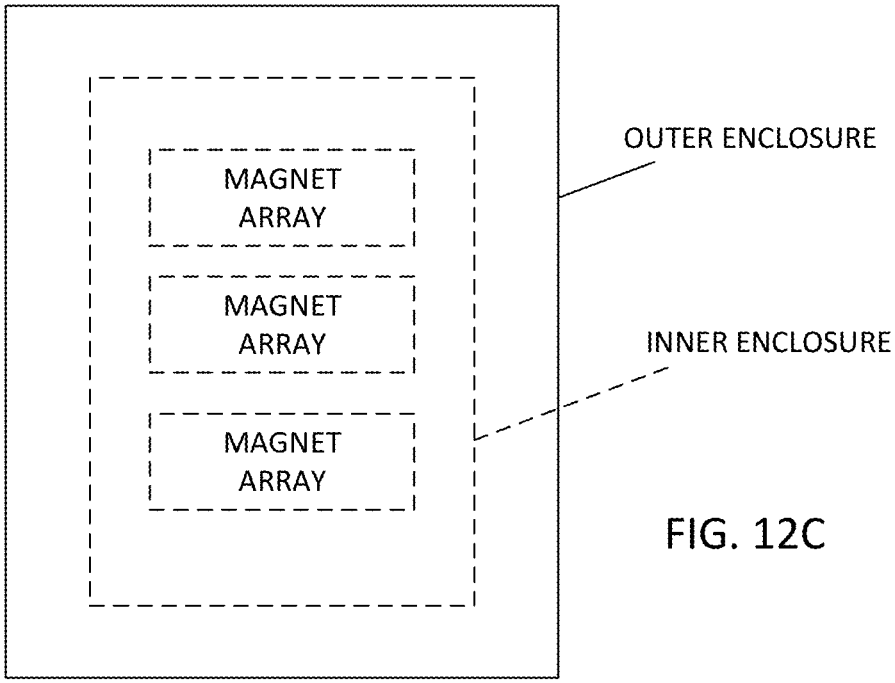

FIGS. 12A-12C show another example embodiment in which a pair of slotted enclosures (e.g., "cans") is disposed concentrically around one or more dipole magnets (e.g., individual magnets or one or more arrays of magnets such as shown in FIGS. 12B and 12C). IN this particular embodiment, for example, FIG. 12A shows a side view of the enclosures (inner and outer enclosures) showing a plurality of vertical, longitudinal slots formed in the sides of the enclosures. FIG. 12B shows an end view of the antenna in which an individual magnet dipole array is shown in dashed lines. FIG. 12C shows a side view of the antenna including an outer enclosure, an inner enclosure shown in dashed lines, and three arrays of dipole magnets also shown in cross-hatch. Each of the enclosures comprises a plurality of slots (e.g., longitudinal or lateral slots), such as shown in the side view of an enclosure in FIG. 12A. The enclosures are disposed around the perimeter of the one or more dipole magnets such that the enclosure material and slots are configured to be positioned in a first closed configuration and a second open configuration depending on the position of one or more of the enclosures. In example embodiments, for example, the enclosures may comprise a first static enclosure and a second rotating enclosure or two counter-rotating enclosures that may be controlled by one or more motors to move the shutter enclosures between the first closed configuration and the second closed configuration.

Although embodiments have been described above with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A magnetic shutter antenna comprising:

at least one dipole magnet comprising a first end and a second end;

at least one shutter of magnetically soft material comprising at least one opening and disposed proximate the first end of the at least one dipole magnet; and a motor coupled to the shutter, the motor configured to move the shutter between a first closed position comprising the magnetic material being positioned adjacent the first end of the dipole magnet and a second open configuration comprising the opening being positioned adjacent the first end of the dipole magnet, wherein alternation between the first closed position and the second open position modulates a magnetic flux emitting from the first end of the at least one dipole magnet.

2. The magnetic shutter antenna of claim 1 wherein the motor is adapted to rotate the at least one shutter to alternate the antenna between the first closed position and the second open position and modulate the magnetic flux emitting from the first end of the dipole magnet.

3. The magnetic shutter antenna of claim 2 wherein the at least one dipole magnet comprises a plurality of dipole magnets disposed in an array.

4. The magnetic shutter antenna of claim 2 wherein the at least one dipole magnet comprises a plurality of dipole magnets disposed in a radial array.

5. The magnetic shutter antenna of claim 4 wherein the radial array of dipole magnets comprises a center recess disposed between the plurality of dipole magnets.

6. The magnetic shutter antenna of claim 5 wherein the motor is disposed within the recess.

7. The magnetic shutter antenna of claim 6 wherein the at least one dipole magnet comprises at least two dipole magnets that form a magnetic component of the motor.

8. The magnetic shutter antenna of claim 6 wherein the at least one dipole magnet comprises at least two dipole magnets that form a component of the motor and the motor comprises at least one rotor configured to index grooves formed in an internal surface of the at least two dipole magnets.

9. The magnetic shutter antenna of claim 1 wherein the motor is adapted to translate the at least one shutter to alternate the antenna between the first closed position and the second open position and modulate the magnetic flux emitting from the first end of the dipole magnet.

10. A magnetic shutter antenna comprising:

at least one dipole magnet comprising a first end and a second end;

a first shutter of magnetically soft material comprising at least one opening and disposed proximate the first end of the at least one dipole magnet;

a second shutter of magnetically soft material comprising at least one opening and disposed proximate the second end of the at least one dipole magnet; and at least one motor coupled to the first and second shutters, the at least one motor configured to move the first and second shutters between a first closed position comprising the magnetic material of the first and second shutters being positioned adjacent the first and second ends of the at least one dipole magnet and a second open configuration comprising the openings of the first and second shutters being positioned adjacent the first and second end of the at least one dipole magnet, wherein alternation between the first closed position and the second open position modulates a magnetic flux emitting from the first and second ends of the at least one dipole magnet.

11. The magnetic shutter antenna of claim 10 wherein the motor is adapted to rotate the first and second shutters to alternate the antenna between the first closed position and the second open position and modulate the magnetic flux emitting from the first end of the dipole magnet.

12. The magnetic shutter antenna of claim 11 wherein the at least one dipole magnet comprises a plurality of dipole magnets disposed in an array.

13. The magnetic shutter antenna of claim 11 wherein the at least one dipole magnet comprises a plurality of dipole magnets disposed in a radial array.

14. The magnetic shutter antenna of claim 13 wherein the radial array of dipole magnets comprises a center recess disposed between the plurality of dipole magnets.

15. The magnetic shutter antenna of claim 14 wherein the motor is disposed within the recess.

16. The magnetic shutter antenna of claim 15 wherein the at least one dipole magnet comprises at least two dipole magnets that form a magnetic component of the motor.

17. The magnetic shutter antenna of claim 15 wherein the at least one dipole magnet comprises at least two dipole magnets that form a component of the motor and the motor comprises at least one rotor configured to index grooves formed in an internal surface of the at least two dipole magnets.

18. The magnetic shutter antenna of claim 10 wherein the motor is adapted to translate the at least one shutter to alternate the antenna between the first closed position and the second open position and modulate the magnetic flux emitting from the first end of the dipole magnet.

19. A method of transmitting a signal with an antenna, the method comprising:

providing a magnetic shutter antenna comprising:

at least one dipole magnet comprising a first end and a second end;

at least one shutter of magnetically soft material comprising at least one opening and disposed proximate the first end of the at least one dipole magnet; and a motor coupled to the shutter, the motor configured to move the shutter between a first closed position comprising the magnetic material being positioned adjacent the first end of the dipole magnet and a second open configuration comprising the opening being positioned adjacent the first end of the dipole magnet, controlling the motor to alternate the at least one shutter between the first closed position and the second open position modulates a magnetic flux emitting from the first end of the at least one dipole magnet.

20. The method of claim 19 wherein the operation of controlling the motor comprises controlling the motor to rotate or translate the at least one shutter between the first closed position and the second open position.

* * * * *